US008128365B2

(12) United States Patent
De Cardenas

(10) Patent No.: US 8,128,365 B2
(45) Date of Patent: Mar. 6, 2012

(54) TURBINE AIRFOIL COOLING SYSTEM WITH ROTOR IMPINGEMENT COOLING

(75) Inventor: Rafael A. De Cardenas, Orlando, FL (US)

(73) Assignee: Siemens Energy, Inc., Orlando, FL (US)

( * ) Notice: Subject to any disclaimer, the term of this patent is extended or adjusted under 35 U.S.C. 154(b) by 940 days.

(21) Appl. No.: 11/825,690

(22) Filed: Jul. 9, 2007

(65) Prior Publication Data

US 2009/0060712 A1 Mar. 5, 2009

(51) Int. Cl.
*F01D 5/08* (2006.01)

(52) U.S. Cl. ..... 416/96 R; 416/193 A

(58) Field of Classification Search ..... 416/95, 416/96 A, 96 R, 190, 193 A, 220 R
See application file for complete search history.

(56) References Cited

U.S. PATENT DOCUMENTS

| | | | | |
|---|---|---|---|---|
| 3,325,144 | A | 6/1967 | Wilde et al. | |
| 3,479,009 | A | 11/1969 | Bean | |
| 3,628,880 | A | 12/1971 | Smuland et al. | |
| 3,728,042 | A | 4/1973 | Hugoson et al. | |
| 3,748,060 | A | 7/1973 | Hugoson et al. | |
| 3,834,831 | A * | 9/1974 | Mitchell | 416/95 |
| 4,021,138 | A | 5/1977 | Scalzo et al. | |
| 4,178,129 | A | 12/1979 | Jenkinson | |
| 4,348,157 | A | 9/1982 | Campbell et al. | |
| 4,531,889 | A | 7/1985 | Grondahl | |
| 4,626,169 | A | 12/1986 | Hsing et al. | |
| 4,820,123 | A | 4/1989 | Hall | |
| 5,281,097 | A * | 1/1994 | Wilson et al. | 416/193 A |
| 5,403,156 | A | 4/1995 | Arness et al. | |
| 5,415,526 | A * | 5/1995 | Mercadante et al. | 416/190 |
| 5,836,742 | A * | 11/1998 | Dierksmeier et al. | 416/95 |
| 5,941,687 | A | 8/1999 | Tubbs | |
| 5,957,660 | A | 9/1999 | Evans et al. | |
| 6,059,529 | A | 5/2000 | Schiavo | |
| 6,981,845 | B2 | 1/2006 | Balland et al. | |
| 7,059,835 | B2 * | 6/2006 | Tiemann | 416/96 R |
| 7,198,463 | B2 | 4/2007 | Kanebako et al. | |
| 2004/0109764 | A1 | 6/2004 | Tiemann | |
| 2004/0115054 | A1 | 6/2004 | Balland et al. | |
| 2005/0047906 | A1 | 3/2005 | McRae, Jr. et al. | |

FOREIGN PATENT DOCUMENTS

| | | |
|---|---|---|
| EP | 1548234 A2 | 6/2005 |
| EP | 1669544 A1 | 6/2006 |
| GB | 2411697 A | 9/2005 |
| JP | 11-22408 | 1/1999 |

* cited by examiner

*Primary Examiner* — Edward Look
*Assistant Examiner* — Ryan Ellis

(57) ABSTRACT

A turbine airfoil cooling system of a turbine engine having a hollow, disc post body positioned between adjacent roots of turbine airfoils and aligned with the roots to cool inner aspects of the turbine engine. The hollow, disc post body may be configured to pass cooling fluids through impingement orifices in the hollow, disc post body to impinge on inner surfaces of platforms of the turbine airfoils. The cooling fluids may then be directed to the internal cooling systems of the turbine airfoils rather than being discharged as film cooling fluids through the platforms of the turbine airfoils.

18 Claims, 2 Drawing Sheets

TURBINE AIRFOIL COOLING SYSTEM WITH ROTOR IMPINGEMENT COOLING

FIELD OF THE INVENTION

This invention is directed generally to turbine airfoils, and more particularly to cooling systems of platforms of hollow turbine airfoils usable in turbine engines.

BACKGROUND

Typically, gas turbine engines include a compressor for compressing air, a combustor for mixing the compressed air with fuel and igniting the mixture, and a turbine blade assembly for producing power. Combustors often operate at high temperatures that may exceed 2,500 degrees Fahrenheit. Typical turbine combustor configurations expose turbine blade assemblies to these high temperatures. As a result, turbine blades must be made of materials capable of withstanding such high temperatures. In addition, turbine blades often contain cooling systems for prolonging the life of the blades and reducing the likelihood of failure as a result of excessive temperatures.

Typically, turbine blades are formed from a root portion having a platform at one end and an elongated portion forming a blade that extends outwardly from the platform coupled to the root portion. Portions of the platform immediately adjacent to the airfoil are typically cooled with internal cooling systems in the blade. The remaining portions of the platform are typically cooled with convection cooling by cooling fluids that are contained in a region that is radially inward of the platforms. The cooling fluids are contained in this region for use in the internal cooling systems of the turbine airfoils. While the cooling fluids reduce the temperature of the platforms, the platforms remain susceptible to localized hot spots caused by exposure to the hot gases in the hot gas path because of a lack of directed cooling. Thus, a need exists for more efficiently cooling the platforms of turbine airfoils.

SUMMARY OF THE INVENTION

This invention relates to a turbine airfoil cooling system for turbine engines and, in particular, for cooling internal aspects of platforms of turbine airfoils. The turbine airfoil cooling system may include a hollow, disc post body configured to be positioned between adjacent roots of turbine airfoils. The hollow, disc post body may include a plurality of impingement orifices in an outer wall for directing cooling fluids into direct contact with inner surfaces of the turbine airfoil platforms and other components of the turbine airfoils. The impingement orifices may be sized and spaced according to localized heat loads to prevent the formation of hot spots.

The hollow, disc post body may be configured to be positioned between adjacent roots of turbine airfoils. The body may include a central cooling fluid cavity extending from a first end of the disc body to a second end of the disc body along a longitudinal axis of the disc body. The body may include an opening in an inner surface of an outer wall of the body creating a cooling fluid pathway for cooling fluids to enter the central cooling fluid cavity. The body may also include a plurality of impingement orifices in the outer wall extending between the central cooling fluid cavity and an outer surface for providing impingement cooling to inner surfaces of platforms of the turbine airfoils.

In one embodiment, the hollow disc body may include an outer surface, an inner surface opposite to the outer surface, two side surfaces opposite to each other and both generally orthogonal to the inner and outer side surfaces, and first and second ends opposite to each other and generally orthogonal to the inner and outer surfaces and to the two side surfaces, thereby forming a generally rectangular body. The two side surfaces may include lengthwise indentations that are generally parallel with the longitudinal axis of the disc body, thereby creating a generally anvil shaped cross-section of the disc body. In one embodiment, the inner surface may have a width that is less than a width of the outer surface. An intersection between a first side surface and the outer surface may be rounded and may include impingement orifices, and an intersection between a second side surface and the outer surface may be rounded and may include impingement orifices.

The turbine airfoil cooling system may also include a cooling fluid supply conduit extending through the opening in the inner surface of the outer wall of the disc post body. The cooling fluid supply conduit may have a cross-sectional area that is less than the opening in the inner surface of the outer wall of the disc post body, thereby allowing the cooling fluid supply conduit to fit into the opening. The cooling fluid supply conduit may be coupled to a conventional cooling fluid source.

An advantage of this invention is that the hollow disc post body cools the platforms of turbine airfoils without modifying the configuration of the turbine blade platforms.

Another advantage of this invention is that the impingement cooling fluids are not discharged into the gas path and can be redirected to the airfoil for reuse, thereby improving efficiency by reducing cooling fluid waste flows and minimizing cooling flow usage.

Yet another advantage of this invention is that the turbine blades are not modified and do not require additional fabrication for use with the hollow disc post body.

Another advantage of this invention is that the hollow disc post body is sheltered from the hot gas path, thereby resulting in robust durability.

Still another advantage of this invention is that the hollow disc post body is positioned in a low stress region.

Another advantage of this invention is that stress concentrations at the top of the cooling fluid supply conduit are less than the stress concentrations at the disc feed holes at the live rim.

Yet another embodiment of this invention is that the cooling fluids could also be exhausted as film cooling air in an alternative embodiment.

These and other embodiments are described in more detail below.

BRIEF DESCRIPTION OF THE DRAWINGS

The accompanying drawings, which are incorporated in and form a part of the specification, illustrate embodiments of the presently disclosed invention and, together with the description, disclose the principles of the invention.

DETAILED DESCRIPTION OF THE INVENTION

Figure 1:
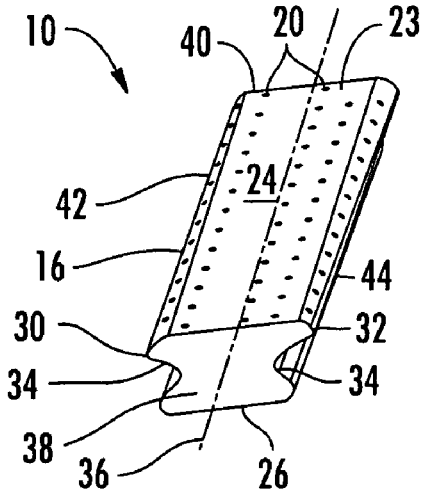
FIG. 1 is a perspective view of a hollow, disc post body of the turbine airfoil cooling system.

As shown in FIGS. 1-4, this invention is directed to a turbine airfoil cooling system 10 for turbine engines and, in particular, for cooling internal aspects of platforms 12 of turbine airfoils 14. The turbine airfoil cooling system 10 may include a hollow, disc post body 16 configured to be positioned between adjacent roots 18 of turbine airfoils 14. The hollow, disc post body 16 may include a plurality of impingement orifices 20 in an outer wall 23 for directing cooling fluids into direct contact with inner surfaces 22 of the platforms 12 and other components of the turbine airfoils 14. The impingement orifices 20 may be sized and spaced according to localized heat loads to prevent the formation of hot spots.

Figure 2:
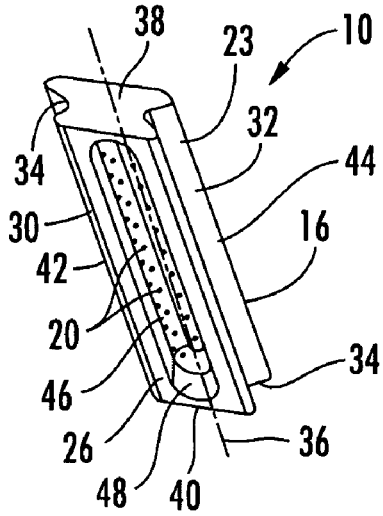
FIG. 2 is a different perspective view of the hollow, disc post body of the turbine airfoil cooling system shown in FIG. 1.

As shown in FIGS. 1 and 2, the turbine airfoil cooling system 10 may be formed from a hollow, disc post body 16 configured to be placed into close proximity with the inner surface 22 of the turbine airfoils 14. In one embodiment, the hollow, disc post body 16 may be formed from an outer surface 24 and an inner surface 26 that is opposite to the outer surface 24. The outer surface 24 may be configured to be placed in close proximity to, such as a desired target distance away from the, inner surface 22 of the turbine airfoil 14. In particular, the outer surface 24 may be configured such that a midline portion 28 be placed in close proximity to, such as a desired target distance away from the, the inner surface 22 thereby enabling cooling fluids to impinge on the inner surface 22 and flow between the inner and outer surfaces 22, 24. In addition, dampers may be placed between the outer surface 24 and the inner surface 22 to control vibrations of the components.

The hollow, disc post body 16 may also be formed from two side surfaces 30, 32, that are opposite to each other and both generally orthogonal to the inner and outer side surfaces 26, 24. The hollow, disc post body 16 may be have any configuration necessary to hold it in place while the engine is running. However, in one embodiment, the two side surfaces 30, 32 may include lengthwise indentations 34 that are generally parallel with a longitudinal axis 36 of the disc body 16, thereby creating a generally anvil shaped cross-section of the disc body 16. An intersection 42 between a first side surface 30 and the outer surface 24 may be rounded and may include impingement orifices 20, and an intersection 44 between a second side surface 32 and the outer surface 24 may be rounded and may include impingement orifices 20. The hollow, disc post body 16 may also be formed from first and second ends 38, 40 opposite to each other and generally orthogonal to the inner and outer surfaces 26, 24 and to the two side surfaces, 30, 32. In one embodiment, as shown in FIG. 3, the inner surface 26 may have a width that is less than a width of the outer surface 24.

The hollow, disc post body 16 may include a central cooling fluid cavity 46 extending from the first end 38 of the disc body 16 to the second end 40 of the disc body 16 along the longitudinal axis 36 of the disc body 16. The disc body 16 may include an opening 48 in the inner surface 26 of the outer wall 23 of the body 16 creating a cooling fluid pathway for cooling fluids to enter the central cooling fluid cavity 46. The hollow, disc post body 16 may also include a plurality of impingement orifices 20 in the outer wall 23 extending between the central cooling fluid cavity 46 and the outer surface 24 for providing impingement cooling to the inner surfaces 22 of the platforms 12 of the turbine airfoils 14. The impingement orifices 20 may be aligned in rows or may be positioned in other appropriate arrangements.

Figure 4:
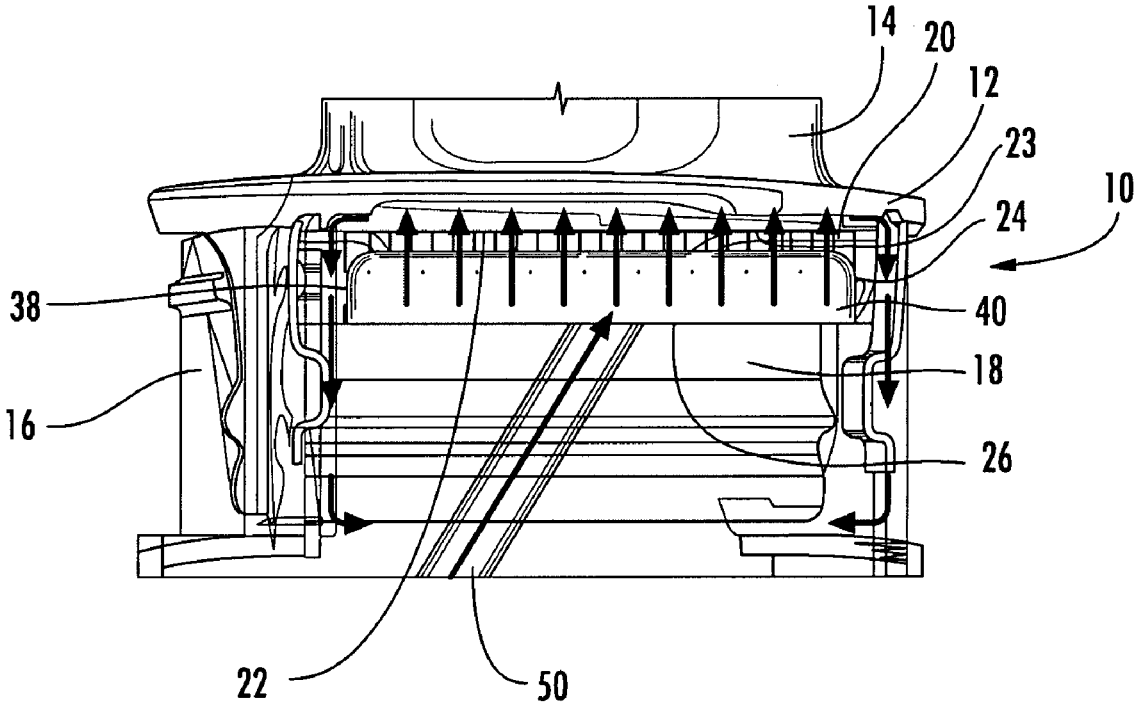
FIG. 4 is a cross-sectional side view of the hollow, disc post body of FIGS. 1 and 2 positioned radially inward of the platforms for cooling the platforms.

The turbine airfoil cooling system 10 may also include a cooling fluid supply conduit 50 extending through the opening 48 in the inner surface 26 of the outer wall 23 of the disc post body 16. The cooling fluid supply conduit 50 may have a cross-sectional area that is less than the opening 48 in the inner surface 26 of the outer wall 23 of the disc post body 16, thereby enabling the cooling fluid supply conduit 50 to extend through the opening 48 and terminate in the central cooling fluid cavity 46. The cooling fluid supply conduit 50 may be coupled to a conventional cooling fluid source in the turbine engine. As shown in FIG. 4, the cooling fluid supply conduit 50 may be positioned nonparallel and nonorthogonally to the hollow, disc post body 16.

Figure 3:
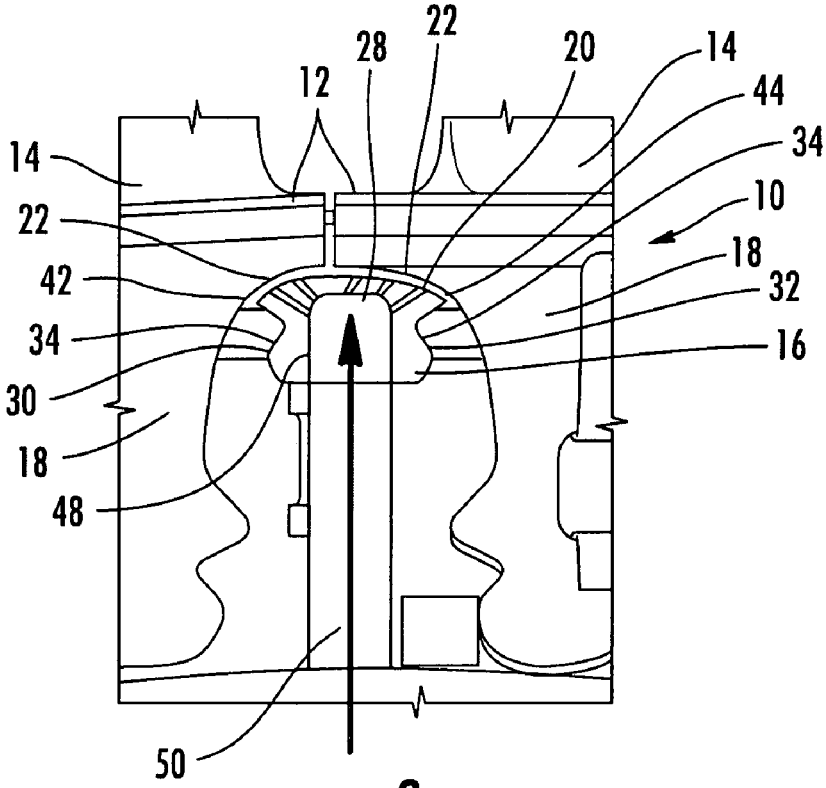
FIG. 3 is an upstream view of two adjacent turbine airfoils extending radially outward from a rotor with a hollow, disc post body of FIGS. 1 and 2 positioned radially inward of the platforms for cooling the platforms.

The hollow disc post body 16 may be generally aligned with the roots 18 of adjacent turbine airfoils 14, as shown in FIG. 3. During use, the cooling fluids may be directed into the central cooling fluid cavity 46. The cooling fluids may be dispersed from the central cooling fluid cavity 46 through the impingement orifices 20, as shown in FIGS. 3 and 4, and impinge on the inner surfaces 22 of the turbine airfoils 14. The impingement cooling fluid may then be circulated in the area between the adjacent roots 18 of the turbine airfoils 14, as shown in FIG. 4, and be drawn into the internal cooling system of the turbine airfoils 14.

The foregoing is provided for purposes of illustrating, explaining, and describing embodiments of this invention. Modifications and adaptations to these embodiments will be apparent to those skilled in the art and may be made without departing from the scope or spirit of this invention.

I claim:

1. A turbine airfoil cooling system, comprising:

a hollow, disc post body configured to be positioned between adjacent roots of turbine airfoils, wherein the body includes a central cooling fluid cavity extending from a first end of the disc body to a second end of the disc body along a longitudinal axis of the disc body, and the body includes an opening in an inner surface of an outer wall of the body creating a cooling fluid pathway for cooling fluids to enter the central cooling fluid cavity, and a plurality of impingement orifices in the outer wall extending between the central cooling fluid cavity and an outer surface for providing impingement cooling to inner surfaces of platforms of the turbine airfoils;

wherein the hollow disc body includes the outer surface, the inner surface opposite to the outer surface, two side surfaces opposite to each other and both generally orthogonal to the inner and outer side surfaces, the first and second ends opposite to each other and generally orthogonal to the inner and outer surfaces and to the two side surfaces, wherein the two side surfaces include lengthwise indentations that are generally parallel with the longitudinal axis of the disc body, thereby creating a generally anvil shaped cross-section of the disc body.

2. The turbine airfoil cooling system of claim 1, wherein the inner surface has a width that is less than a width of the outer surface.

3. The turbine airfoil cooling system of claim 1, wherein an intersection between a first side surface and the outer surface is rounded and includes impingement orifices.

4. The turbine airfoil cooling system of claim 3, wherein an intersection between a second side surface and the outer surface is rounded and includes impingement orifices.

5. The turbine airfoil cooling system of claim 1, further comprising a cooling fluid supply conduit extending through the opening in the inner surface of the outer wall of the disc post body.

6. The turbine airfoil cooling system of claim 5, wherein the cooling fluid supply conduit has a cross-sectional area that is less than the opening in the inner surface of the outer wall of the disc post body.

7. A turbine airfoil cooling system, comprising:

a hollow, disc post body positioned between adjacent roots of turbine airfoils and aligned with the roots, wherein the body includes a central cooling fluid cavity extending from a first end of the disc body to a second end of the disc body along a longitudinal axis of the disc body, the body including an opening in an inner surface of an outer wall of the body creating a cooling fluid pathway for cooling fluids to enter the central cooling fluid cavity, a plurality of impingement orifices in the outer wall extending between the central cooling fluid cavity, and an outer surface for providing impingement cooling to inner surfaces of platforms of the turbine airfoils;

wherein the hollow disc body includes the outer surface, the inner surface opposite to the outer surface, two side surfaces opposite to each other and both generally orthogonal to the inner and outer side surfaces, the first and second ends opposite to each other and generally orthogonal to the inner and outer surfaces and to the two side surfaces, wherein the two side surfaces include lengthwise indentations that are generally parallel with the longitudinal axis of the disc body, thereby creating a generally anvil shaped cross-section of the disc body.

8. The turbine airfoil cooling system of claim 7, wherein the inner surface has a width that is less than a width of the outer surface.

9. The turbine airfoil cooling system of claim 7, wherein an intersection between a first side surface and the outer surface is rounded and includes impingement orifices.

10. The turbine airfoil cooling system of claim 9, wherein an intersection between a second side surface and the outer surface is rounded and includes impingement orifices.

11. The turbine airfoil cooling system of claim 7, further comprising a cooling fluid supply conduit extending through the opening in the inner surface of the outer wall of the disc post body.

12. The turbine airfoil cooling system of claim 11, wherein the cooling fluid supply conduit has a cross-sectional area that is less than the opening in the inner surface of the outer wall of the disc post body.

13. The turbine airfoil cooling system of claim 7, wherein the platforms of the adjacent turbine blades are sealed together to prevent cooling fluids from being exhausted between the turbine blades.

14. A turbine airfoil cooling system, comprising:

a hollow, disc post body positioned between adjacent roots of turbine airfoils and aligned with the roots, wherein the body includes a central cooling fluid cavity extending from a first end of the disc body to a second end of the disc body along a longitudinal axis of the disc body, the body including an opening in an inner surface of an outer wall of the body creating a cooling fluid pathway for cooling fluids to enter the central cooling fluid cavity, and a plurality of impingement orifices in the outer wall extending between the central cooling fluid cavity and an outer surface for providing impingement cooling to inner surfaces of platforms of the turbine airfoils;

wherein the hollow disc body includes the outer surface, the inner surface opposite to the outer surface, two side surfaces opposite to each other and both generally orthogonal to the inner and outer side surfaces, the first and second ends opposite to each other and generally orthogonal to the inner and outer surfaces and to the two side surfaces, wherein the two side surfaces include lengthwise indentations that are generally parallel with the longitudinal axis of the disc body, thereby creating a generally anvil shaped cross-section of the disc body; and a cooling fluid supply conduit extending through the opening in the inner surface of the outer wall of the disc post body.

15. The turbine airfoil cooling system of claim 14, wherein the inner surface has a width that is less than a width of the outer surface.

16. The turbine airfoil cooling system of claim 14, wherein an intersection between a first side surface and the outer surface is rounded and includes impingement orifices, and wherein an intersection between a second side surface and the outer surface is rounded and includes impingement orifices.

17. The turbine airfoil cooling system of claim 14, wherein the cooling fluid supply conduit has a cross-sectional area that is less than the opening in the inner surface of the outer wall of the disc post body.

18. The turbine airfoil cooling system of claim 14, wherein the platforms of the adjacent turbine blades are sealed together to prevent cooling fluids from being exhausted between the turbine blades.

* * * * *